US010059023B2

(12) United States Patent
Baro Cabrero

(10) Patent No.: US 10,059,023 B2
(45) Date of Patent: Aug. 28, 2018

(54) DUAL ANGLE GUIDE FOR CERAMIC CUTTING MACHINES

(71) Applicant: BELLOTA HERRAMIENTAS, S.A., Legazpia (Guipuzcoa) (ES)

(72) Inventor: Josep Baro Cabrero, Legazpia (ES)

(73) Assignee: BELLOTA HERRAMIENTAS, S.A., Legazpia (Guipuzcoa) (ES)

( * ) Notice: Subject to any disclaimer, the term of this patent is extended or adjusted under 35 U.S.C. 154(b) by 45 days.

(21) Appl. No.: 14/612,327

(22) Filed: Feb. 3, 2015

(65) Prior Publication Data

US 2015/0217482 A1 Aug. 6, 2015

(30) Foreign Application Priority Data

Feb. 4, 2014 (ES) ..... 201430150 U

(51) Int. Cl.
*B27B 27/08* (2006.01)
*B28D 7/04* (2006.01)
*B28D 1/22* (2006.01)

(52) U.S. Cl.
CPC ..... *B27B 27/08* (2013.01); *B28D 1/225* (2013.01); *B28D 7/043* (2013.01); *Y10T 83/76* (2015.04)

(58) Field of Classification Search
CPC . Y10T 83/7593; Y10T 83/76; Y10T 83/7607; Y10T 83/7613; Y10T 83/762; Y10T 83/7627; Y10T 83/4647; B27B 27/00; B27B 27/04; B27B 27/06; B27B 27/08; B27B 27/10; B27B 27/02; B28D 7/043; B28D 1/225
See application file for complete search history.

(56) References Cited

U.S. PATENT DOCUMENTS 1,299,367 A * 4/1919 McMichael et al. ... B27B 25/10 33/613
2,905,210 A * 9/1959 Thomas ..... B27B 25/10 83/416

(Continued)

FOREIGN PATENT DOCUMENTS

CA 2273454 A1 * 12/1999 ..... B23D 45/105
DE 1961169 A1 * 8/1970 ..... B28D 1/225

(Continued)

OTHER PUBLICATIONS

English Translation of FR2711939.*

*Primary Examiner* — Jennifer Swinney
(74) *Attorney, Agent, or Firm* — Wenderoth, Lind & Ponack, L.L.P.

(57) ABSTRACT

A dual angle guide (3) for ceramic cutting machines (1) includes a base (16); first and second positioning elements (4, 5) disposed on the base; a sector (9) calibrated with fixed angles for each positioning element; a first fixed stop (11) and a second fixed stop (12) for locating the positioning elements at a chosen angle on the respective calibrated sector (9); and rotation elements (13) for rotating the positioning elements in such a way that the positioning elements make it possible to make cuts in the ceramic piece (10) at different angles. The cuts are made by a cutting tool mounted to a sliding carriage (6). Each of the first and second positioning elements is rotatable in both a clockwise direction and an anti-clockwise direction in order to facilitate the scoring and cutting of the ceramic piece at various angles.

11 Claims, 5 Drawing Sheets

(56) References Cited

U.S. PATENT DOCUMENTS

| | | | | | |
|---|---|---|---|---|---|
| 3,830,127 | A * | 8/1974 | James | B27B 25/06 | 83/425.2 |
| 4,433,600 | A * | 2/1984 | Ikeda | B23D 15/002 | 144/217 |
| 4,464,962 | A * | 8/1984 | Myhre | B27B 25/10 | 83/425 |
| 5,169,045 | A * | 12/1992 | Liu | B28D 1/225 | 125/23.02 |
| 6,164,272 | A * | 12/2000 | Fouy | B28D 1/225 | 125/12 |
| 8,578,923 | B2 * | 11/2013 | Ghelfi | B28D 1/225 | 125/23.01 |
| 2002/0112715 | A1 * | 8/2002 | Huang | B23D 47/04 | 125/12 |

FOREIGN PATENT DOCUMENTS

| | | | | |
|---|---|---|---|---|
| DE | 29713661 | U1 * | 10/1997 | B25H 1/10 |
| FR | 2711939 | A3 * | 5/1995 | B28D 1/225 |
| FR | 2715096 | A3 * | 7/1995 | B28D 1/225 |

* cited by examiner

DUAL ANGLE GUIDE FOR CERAMIC CUTTING MACHINES

BACKGROUND OF THE INVENTION

1. Technical Field

The object of the present invention relates to a dual angle guide for use in machines designed to cut pieces of ceramic, in order to be able to make precise cuts in any angular position, both in a clockwise and anti-clockwise direction. The invention is particularly applicable within the field of the construction industry.

2. Description of the Related Art and Technical Problem to be Solved

Manual ceramic cutting machines typically comprise a base upon which the piece of ceramic to be cut is placed, an element for positioning the ceramic piece on the base and a carriage that slides on guides, with a tool-bearing element upon which a cutting tool commonly referred to as a "scoring wheel" is inserted, formed by a handle and a cutting blade commonly known as a "scribe".

The element for positioning the ceramic piece generally comprises a number of stops, which serve to hold the ceramic piece and generally have a built-in ruler, in order to facilitate exact knowledge of the location of the cut to be made.

The fact that a fixed stop is used guarantees that a 90° support is always available whilst scoring the ceramic piece.

Mobile or guide stops also exist, to which a ruler may be added, which likewise serve to support the ceramic piece and make it possible to score lines at different angles.

The problem with these guides is that, in many cases, it is only possible to score lines in one certain rotational direction, since the range of degrees at which the ceramic piece may be positioned on the base is limited, given that if a number of established degrees were exceeded, the ceramic piece would no longer fall within the range of the scribe.

As such, the present invention aims to resolve a problem not answered by the current state of the art, namely:

Making it possible to make cuts at different angles without any kind of limitation, both in a clockwise and anti-clockwise direction, the ceramic piece being supported on the base of the cutting machine, thus facilitating the cut.

SUMMARY OF THE INVENTION

The present invention relates to a dual angle guide for ceramic cutting machines.

The dual angle guide comprises a first positioning element and a second positioning element, which rotate in a clockwise and anti-clockwise direction, both of which may be regulated in order to facilitate the scoring and cutting of the ceramic piece at different angles.

The dual guide comprises a sector calibrated with fixed angles for each positioning element.

The positioning elements make it possible to make cuts in the ceramic piece at different angles. These cuts are made by means of the cutting tool mounted to a sliding carriage. The ceramic piece is always supported on the base of the cutting machine.

The dual guide comprises a first fixed stop and a second fixed stop, which make it possible to locate the positioning elements at a chosen angle on the calibrated sector.

The fixed stops comprise a nut inserted into a hole, where said hole prevents the nut from moving and; a cap threaded onto said nut, in order to fasten the positioning elements into a certain position.

Each positioning elements are independent from one another.

In turn, the positioning elements comprise a number of rotation elements, which facilitate the rotation of the same.

The dual angle guide for ceramic cutting machines comprises: a stop element and a latch element, which connects the stop element to the positioning element, where one end of the latch element is introduced into the stop element and the other end of the latch element is introduced into the stop element and the other end of the latch element is introduced into a flute comprised in each positioning element, in such a way that the stop element is contiguous to the positioning element and serves to support the ceramic pieces.

A bent piece may be incorporated into the stop element, in such a way that said bent piece is displaced longitudinally along the length of the stop element and of one of the positioning elements. Said bent piece is joined by means of fastening elements to a mobile piece inserted into the stop element, said stop element serving to guide the mobile piece.

Each positioning element comprises at least two lock holes, into which at least two locking pins are threaded, which fit into at least two recesses in the latch element, thus fastening the latch element to each positioning element.

The locking pins comprise an internal spring and at one end, a retractable sphere, which fits into the recesses comprised in the latch element.

Each calibrated sector comprises a concentric groove with an arched profile, where a calibrated scale is incorporated towards the outside of said groove.

The positioning elements may comprise a calibrated ruler.

BRIEF DESCRIPTION OF THE DRAWINGS

In order to complete the present description, with the aim of facilitating a better understanding of the characteristics of the invention. The present descriptive specification is accompanied by a set of drawings, which form an intrinsic part thereof and constitute a non-limiting illustration of the following.

Figure 1:
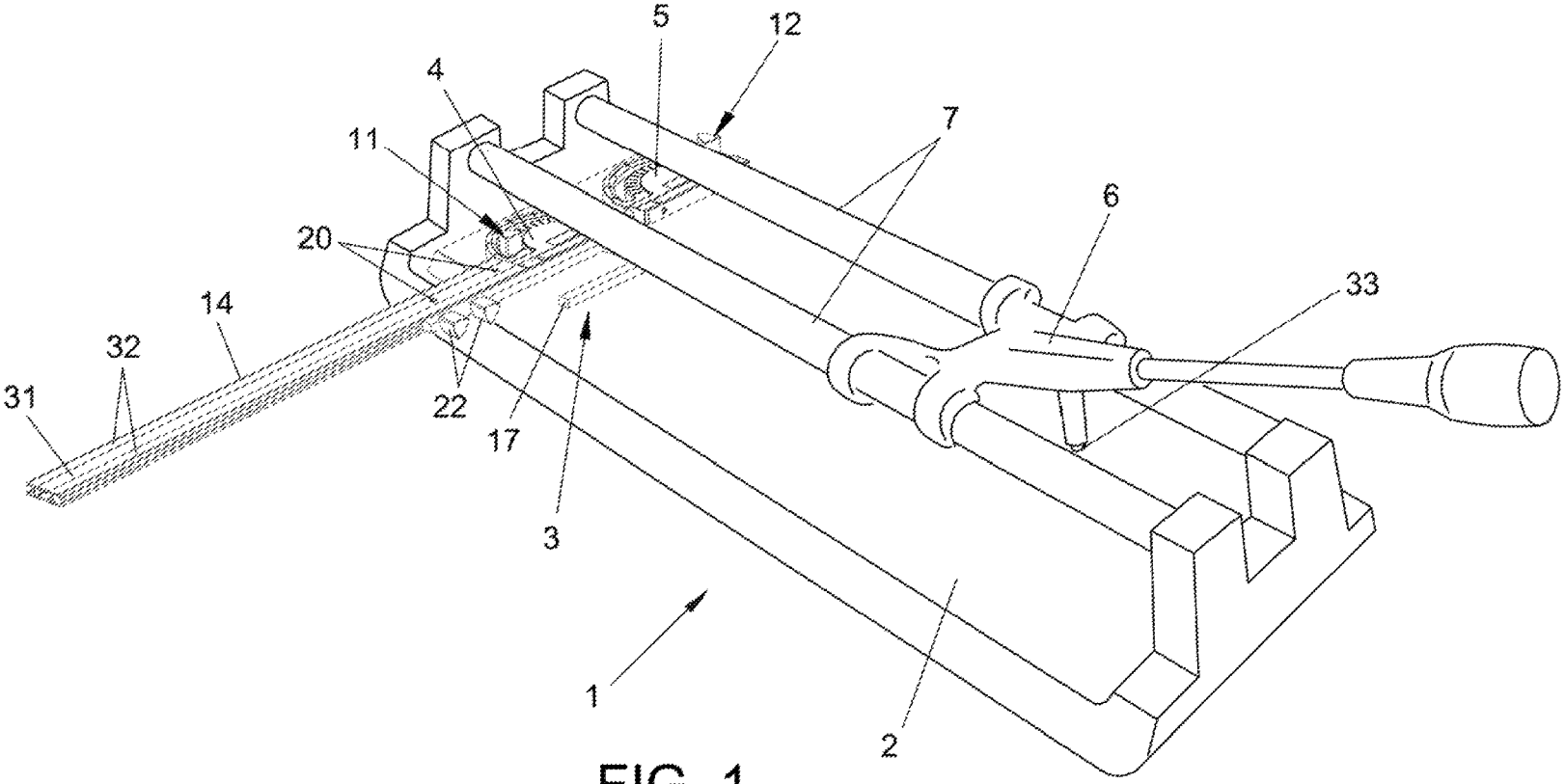
FIG. 1 is an isometric perspective view of the machine for cutting ceramic pieces with the dual guide of the invention.

Below is a list of the various elements represented in the drawings pertaining to the invention:

1. Machine for cutting ceramic pieces,

2. Base of the cutting machine,

3. Dual angle guide,
4. First positioning element,
5. Second positioning element,
6. Sliding carriage,
7. Guides,
8. Calibrated ruler,
9. Sector calibrated with fixed angles,
10. Ceramic piece,
11. First fixed stop,
12. Second fixed stop,
13. Element for rotating the positioning elements,
14. Stop element,
15. Latch element,
16. Base of the dual angle guide,
17. Bent piece,
18. Nut,
19. Cap,
20. Screws,
21. Mobile piece,
22. Fastening elements,
23. Recesses,
24. Flute,
25. Locking pins,
26. Retractable sphere,
27. Nut hole,
28. Stop element holes,
29. Latch element holes,
30. Lock hole,
31. Central portion of the stop element,
32. Side portions of the stop element,
33. Cutting tool.

DETAILED DESCRIPTION OF THE INVENTION

The present invention relates to a dual angle guide (3) for use in machines for cutting (1) ceramic pieces, which makes it possible to score ceramic pieces (10) at different angles.

In FIG. 1, it is possible to observe the machine for cutting (1) ceramic pieces, which comprises a base (2) upon which the ceramic pieces (10) to be cut are placed. The cutting tool (33) is included in the sliding carriage (6), which is displaced along the length of the guides (7).

The dual angle guide (3) is made up of an assembly of pieces located at one of the ends of the base (2) of the cutting machine, in such a way that it is possible to position the ceramic piece (10) in order to score an angle from any of the sides of the base (2) of the cutting machine.

The dual guide (3) comprises:

- a dual angle guide base (16), upon which the remainder of the elements in the dual angle guide (3) are located;
- a first positioning element (4), which rotates in both a clockwise and anti-clockwise direction, it being possible to regulate the same in order to facilitate the scoring and cutting of the ceramic piece (10) at different angles;
- a second positioning element (5), which rotates in both a clockwise and anti-clockwise direction, it being possible to regulate the same in order to facilitate the scoring and cutting of the ceramic piece (10) at different angles;
- a sector (9) calibrated with fixed angles for each positioning element (4, 5);
- a first fixed stop (11) and a second fixed stop (12), which make it possible to locate the positioning elements (4,5) at a chosen angle; and
- rotation elements (13) for rotating the positioning elements (4, 5).

The positioning elements (4, 5) rotate on the rotation elements (13) in order to be able to make cuts at different angles and are fastened in the desired position according to the fixed stops (11, 12). The fixed stops (11, 12) hold each positioning element (4, 5) at a chosen angle, in order to make the cut in accordance with this angle, be it at 0° or any other angle. Should the positioning elements (4, 5) be fastened on the calibrated sector (9) at 0°, this would guarantee that the ceramic piece (10) is scored at 90°.

Figure 5:
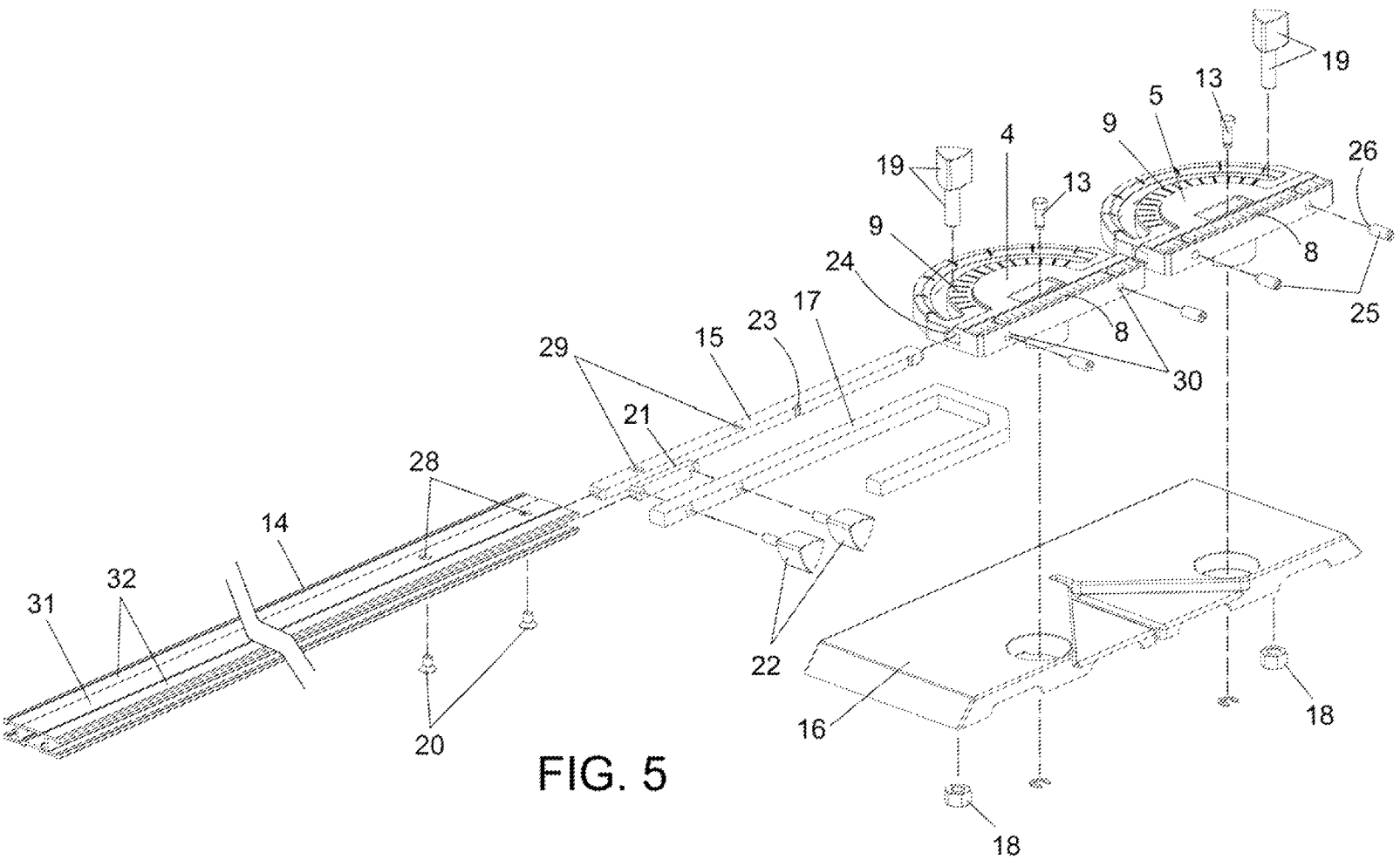
FIG. 5 is an exploded view of the elements shown in the previous figure.

In turn, each positioning element (4, 5) may comprise a calibrated ruler (8), which facilitates knowledge of the exact position of the cut in the ceramic piece, as can be seen in FIG. 5.

Both the first fixed stop (11) and the second fixed stop (12) are designed in the same way, such that both stops (11, 12) comprise:

- a nut (18), which is inserted into a hole (27), where said hole (27) is hexagonal in shape and prevents the nut (18) from moving; and
- a cap, which is threaded onto the nut (18) in order to fasten the positioning elements (4, 5) in a certain position, such that they cannot move.

Figure 3:
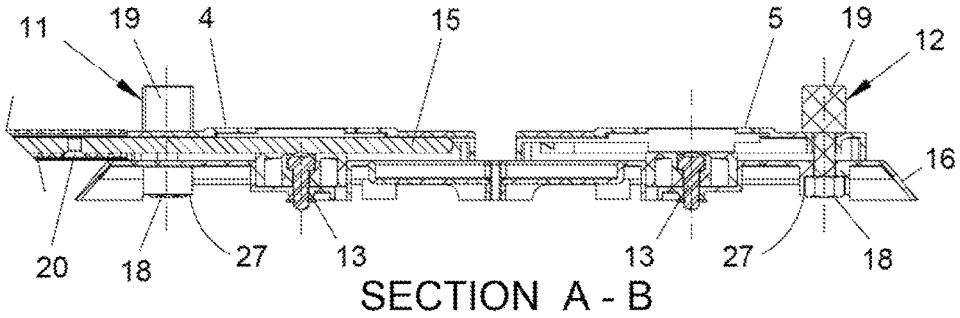
FIG. 3 is a plan view of the cutting machine with the dual angle guide and a ceramic piece positioned according to a correct angle. It is possible to observe the potential cutting of another ceramic piece by looking at the dotted line, this time to be cut in the opposite direction. It is also possible to observe a dotted line representing the line along which the cut is to be made in the ceramic pieces, which in turn constitutes the symmetry axis of the cutting machine. In the upper portion, it is possible to observe a crosswise cut, i.e. cutline A-B, which shows certain elements of the dual angle guide in detail.
Figure 3:
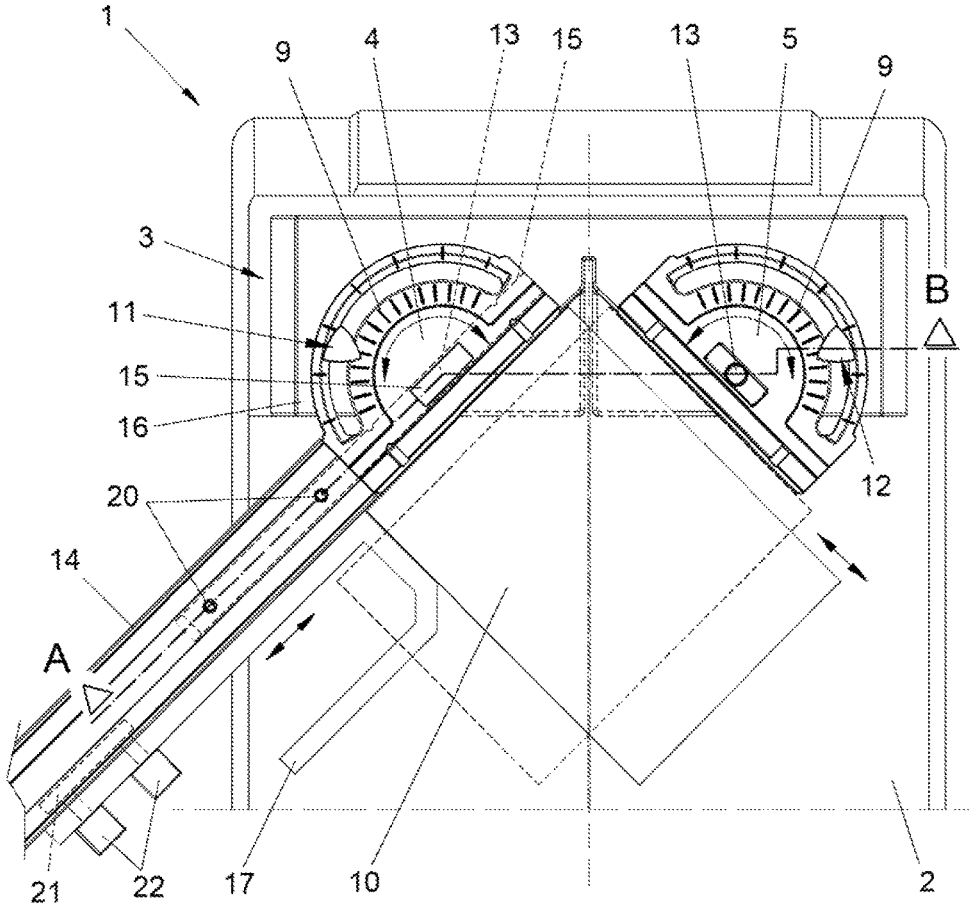

In the upper portion of FIG. 3, it is possible to observe crosswise cutline A-B, which shows the nut (18) and the cap (19) that make up the fixed stops (11, 12).

The calibrated sector (9) comprises a concentric groove with an arched profile, where a calibrated scale is incorporated towards the outside of the groove.

The positioning elements (4, 5) are independent from one another.

The dual angle guide (3) for ceramic cutting machines (1) also comprises:

- a stop element (14); and
- a latch element (15), which connects the stop element (14) to the positioning element (4, 5).

Figure 4:
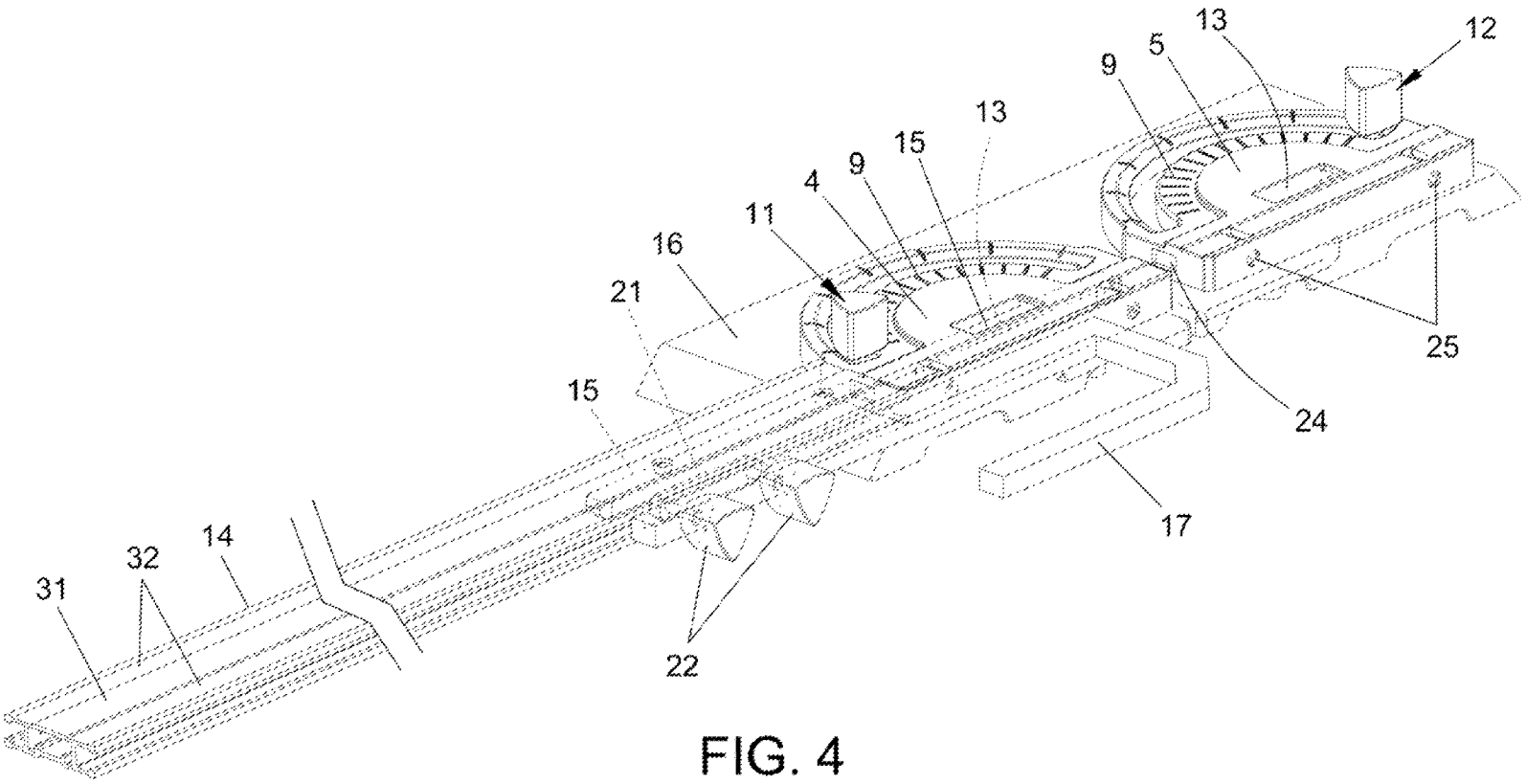
FIG. 4 is a perspective view of the elements that make up the mounting of the bent piece relative to the positioning elements.

One end of the latch element (15) is introduced into the stop element (14) and the other end of the latch element (15) is introduced into a flute (24) formed in each positioning element (4, 5), in such a way that the stop element (14) is contiguous to the positioning element (4, 5) and serves to support the ceramic pieces (10), as can be seen in FIG. 4.

The stop element (14), which comprises holes (28), makes it possible for the latch element (15), which in turn comprises holes (29), to be inserted into and fastened to the stop element (14), as a result of the holes (28, 29) corresponding with one another by means of screws (20).

In FIG. 3, it is possible to observe how in the first positioning element (4), the latch element (15) hides the rotation element (13), whilst in the second positioning element (5), the rotation element (13) is perfectly visible, upon there being no latch element (15).

A bent piece (17) may be incorporated into the stop element (14), in such a way that the bent piece (17) is displaced longitudinally along the length of the stop element (14) and of one of the positioning elements (4, 5), where the bent piece (17) is joined by means of fastening elements (22) to a mobile piece (21) inserted into the stop element (14), the stop element (14) serving to guide the mobile piece (21). The bent piece (17) may be moved and adjusted to the size of the ceramic piece (10) to be cut. It may also be easily coupled to and uncoupled from the positioning elements (4, 5).

The stop element (14) may be used with or without the bent piece (17).

Each positioning element (4, 5) comprises two lock holes (30), where two locking pins (25) with a spring inside are threaded, at one end of which there is a retractable sphere (26), in such a way that, upon introducing the latch element (15) into the flute (24) comprised in each positioning element (4, 5), the retractable spheres (26) are inserted into the recesses (23) of the latch element (15), thus fastening the latch element (15) and stop element (14) to each positioning element (4, 5).

Although the two locking pins (25) guarantee secure fastening, more locking pins (25) may nevertheless be incorporated, in order to improve the hold.

In FIG. 4, it is possible to observe how the stop element (14) comprises a central portion (31), into which the latch element (15) is inserted, alongside two side portions (32) by way of guides, upon which the mobile piece (21), which is displaced freely, is inserted, the same being represented by a dotted line.

Given the symmetrical nature of the latch element (15), the bent piece (17) may be used in any of the positioning elements (4, 5); one would merely have to remove the latch element (15) from one positioning element and introduce it into the other, locking the same using the retractable spheres (26).

The locking pins (25) may be fastened to each positioning element (4, 5) more tightly or loosely, in such a way that the connection between the latch element (15) and the positioning element (4, 5) becomes either more or less rigid.

The ceramic pieces (10) are supported on both the positioning elements (4, 5) and, additionally, on the bent piece (17), thus more easily guaranteeing the position thereof during cutting and separation, when they are arranged in a sloped manner relative to the symmetry axis of the cutting machine (1).

Figure 2:
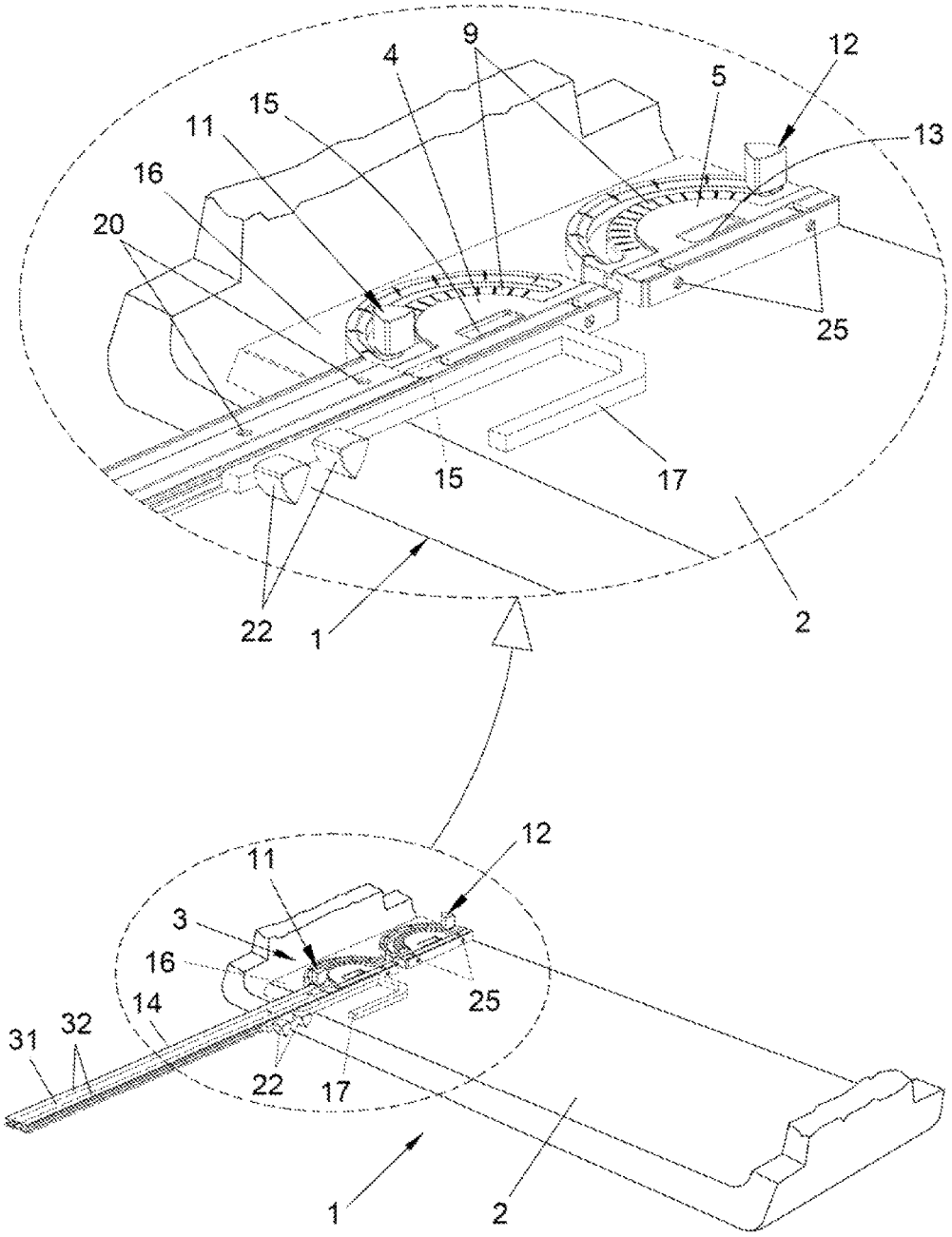
FIG. 2 is a detailed view of the dual angle guide with all the elements that make up the same.

FIG. 2 provides a detailed view of the dual guide (3), wherein each positioning element (4, 5) comprises a sector calibrated (9) with fixed angles, with different angles being included thereon, to be selected in order to make the cut in the ceramic piece (10).

In FIG. 3, it is possible to observe the cut made in a ceramic piece (10) at a certain angle of inclination, upon positioning it according to the first positioning element (4). Likewise, a dotted line shows how the ceramic piece (10) would have been cut according to the angle selected in the second positioning element (5).

The present invention is by no means limited to the embodiment described herein. Other embodiments may be realized by ordinary experts in the field in view of the present description. As such, the scope of the invention is defined in the claims below.

The invention claimed is:

1. A ceramic cutting machine comprising:

a dual angle guide;

a cutting machine base;

a sliding carriage mounted on the cutting machine base; and a cutting tool mounted on the sliding carriage, wherein the dual angle guide comprises:

a dual angle guide base disposed on the cutting machine base;

a first positioning element and a second positioning element disposed on the dual angle guide base, the first and second positioning elements being rotatable in both a clockwise direction and an anti-clockwise direction so as to be regulatable in order to facilitate scoring and cutting of a ceramic piece at different angles;

first and second sectors calibrated with fixed angles, the first and second sectors being arranged on the first and second positioning elements, respectively;

first and second fixed stops, which locate the first and second positioning elements at a chosen angle on the respective calibrated sector; and rotation elements, which facilitate rotation of the first and second positioning elements such that the positioning elements are independent from one another and make it possible to cut the ceramic piece at different angles with the ceramic piece always being supported on the cutting machine base, wherein the dual angle guide further comprises a stop element and a latch element connecting the stop element to the positioning element, wherein an end of the latch element is introduced into the stop element and another end of the latch element is introduced into a flute formed in the first positioning element, in such a way that the stop element is contiguous to the first positioning element.

2. The ceramic cutting machine according to claim 1, wherein each of the first fixed stop and the second fixed stop comprises:

a nut inserted into a hole, where the hole prevents the nut from moving; and a cap threaded onto the nut in order to fasten the respective positioning element in a specific position.

3. The ceramic cutting machine according to claim 1, wherein the dual angle guide further comprises a bent piece and a mobile piece inserted into the stop element, wherein the bent piece is joined to the mobile piece by fastening elements, the stop element serving as a guide for the mobile piece, in such a way that the bent piece is displaced longitudinally along a length of the stop element and one of the first and second positioning elements.

4. The ceramic cutting machine according to claim 3, wherein each of the first and second positioning elements comprises at least two lock holes, wherein at least two locking pins are threaded, which fit into at least two recesses comprised in the latch element, thereby fastening the latch element to at least one of the first and second positioning elements.

5. The ceramic cutting machine according to claim 4, wherein each of the locking pins comprises an internal spring and has a retractable sphere at one end, the sphere fitting into the recesses in the latch element.

6. The ceramic cutting machine according to claim 1, wherein each calibrated sector comprises a concentric groove with an arched profile, and a calibrated scale located towards the outside of the groove.

7. The ceramic cutting machine according to claim 1, wherein each of the first and second positioning elements comprises a calibrated ruler.

8. The ceramic cutting machine according to claim 1, wherein each of the first and second positioning elements comprises at least two lock holes, wherein at least two locking pins are threaded, and fit into at least two recesses in the latch element, thereby fastening the latch element to at least one of the first and second positioning elements.

9. The ceramic cutting machine according to claim 8, wherein each of the locking pins comprises an internal spring and a retractable sphere at one end, the retractable sphere fitting into the recesses in the latch element.

10. The ceramic cutting machine according to claim 1, wherein each of the first and second positioning elements are rotatably mounted on one of the rotating elements, and the first and second positioning elements are separated from each other.

11. The ceramic cutting machine according to claim 1, wherein the dual angle guide is positioned at an end of the cutting machine base.

* * * * *